US005615432A

United States Patent [19]

Von Ohlen, III

[11] Patent Number: 5,615,432

[45] Date of Patent: Apr. 1, 1997

[54] HEAD AND NECK SUPPORT DEVICE

[76] Inventor: Thomas F. Von Ohlen, III, 14 Cardinal Rd., Weston, Conn. 06883

[21] Appl. No.: 478,333

[22] Filed: Jun. 7, 1995

[51] Int. Cl.[6] ..... A47C 20/02

[52] U.S. Cl. ..... 5/638; 5/636; 5/640; 5/643

[58] Field of Search ..... 5/636, 638, 640, 5/643

[56] References Cited

U.S. PATENT DOCUMENTS

| | | | |
|---|---|---|---|
| D. 229,266 | 11/1973 | Zacharias | 5/636 X |
| 3,140,497 | 7/1964 | Carswell | 5/643 X |
| 3,667,074 | 6/1972 | Emery | 5/636 |
| 3,694,831 | 10/1972 | Treace | 5/638 |
| 4,424,599 | 1/1984 | Haannouche | 5/436 |
| 4,752,064 | 6/1988 | Voss | 5/638 |
| 4,777,678 | 10/1988 | Moore | 5/431 |
| 4,779,297 | 10/1988 | Sturges | 5/638 X |
| 4,821,355 | 4/1989 | Burkhardt | 5/434 |
| 5,038,432 | 8/1991 | Robillard et al. | 5/442 |
| 5,257,429 | 11/1993 | Genis | 5/640 X |
| 5,269,035 | 12/1993 | Hartunian | 5/638 |
| 5,287,576 | 2/1994 | Fraser | 5/636 X |
| 5,343,582 | 9/1994 | Baylor | 5/636 X |

*Primary Examiner*—Peter M. Cuomo
*Assistant Examiner*—Stephen Vu
*Attorney, Agent, or Firm*—Michael R. Novack

[57] ABSTRACT

An apparatus for supporting an individual's head or neck which includes a base member and a cushion portion being removably mounted on and spaced from the base member. The cushion portion includes a first section adapted to support an individual's head or neck, and additional recessed regions extending angularly from each end of the first section to form a substantially u-shaped cushion portion. The cushion portion is selectably engageable with an individual's head or neck forming an air channel when an individual lies in a horizontal prone position.

2 Claims, 2 Drawing Sheets

HEAD AND NECK SUPPORT DEVICE

FIELD OF THE INVENTION

This invention relates to a head and neck support device, and more particularly a support apparatus suited for persons reclining in a face up or face down horizontal position.

BACKGROUND OF THE INVENTION

Reclining at the beach in a face up or face down horizontal position for an extended period of time requires constant adjustment of one's head to avoid undesirable stiffness to the neck area. In an attempt to alleviate the stiffness to one's neck, an individual will attempt to use a rolled up shirt, towel, or even a pillow for support. However, these measures often do not provide the proper support to the head and neck region. Also, an individual's ability to comfortably breath while reclining in a face down position is considerably impaired by using the aforementioned conventional methods for head support.

Traditionally, cervical pillows have been used for alleviating back and neck problems by providing support to the neck of an individual. A variety of designs for cervical pillows have been suggested. For instance, U.S. Pat. No. 4,424,599 issued to Hannouche, discloses a cervical pillow which provides corrective support to the neck of an individual in a supine position. Other designs for cervical pillows are disclosed in U.S. Pat. Nos. 5,038,432 and 4,821,355. Although a variety of cervical pillow designs have addressed some of the support and comfort concerns of individuals, there is room for improvement in their design and application. For instance, an individual using a cervical pillow at the beach in a face down position, will not be able to respire comfortably for any extended period of time.

Accordingly, it is among the objects of the present invention to provide a device which allows an individual to recline comfortably in a horizontal position for extended periods of time, and to provide a device which allows an individual to respire comfortably while maintaining such position.

SUMMARY OF THE INVENTION

As discussed above, the inability of an individual to maintain a naturally comfortable position while lying face up or face down, especially at the beach, is a significant problem.

Accordingly, Applicant provides a device which allows an individual to lie comfortable in a horizontal position for extended periods of time, whether reclining in a face up or face down position. The device comprises: a base member and a horseshoe shaped face rest cushion portion, said cushion portion being removably mounted on and spaced from said base portion.

One important benefit of Applicant's device is its ability to stabilize the users head and neck region, even when the user falls asleep. Another important benefit of Applicant's device is the individuals ease of respiration, since the face region of the individual has access to fresh air.

Further features and advantages of the invention will become more readily apparent from the following detailed description when taken in conjunction with the accompanying drawings.

DETAILED DESCRIPTION

Figure 1:
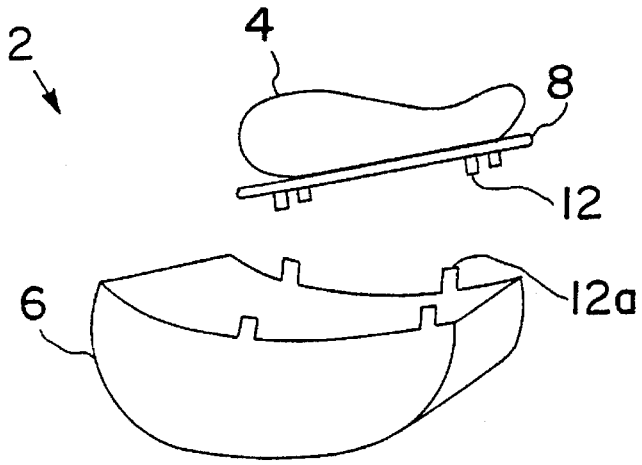
FIG. 1 is a perspective view of a head and support device of the present invention.
Figure 4:
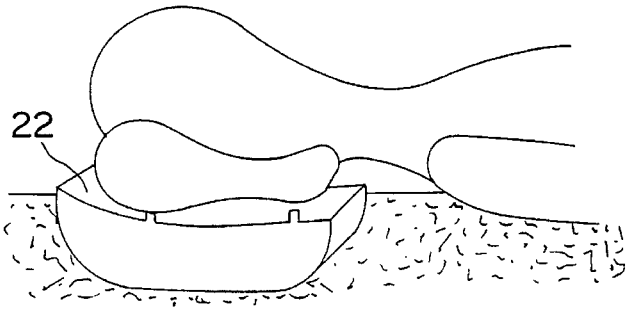
FIG. 4 is a side elevational view of a user of the apparatus of FIG. 3 in a prone face-down position.

FIG. 1 discloses an embodiment of the present invention. The face rest cushion portion of apparatus 2, is removably mounted to base member 6. Base member 6, is made of any suitably stiff material such as plastic, wood, or metal. In a preferred embodiment, the cushion portion 4, is removably mounted to the base member 6, utilizing mounting means 12, attached to cushion frame 8. The base member 6, is partially submerged in soft ground 20, such as sand, forming a temporary pocket 22 (as seen in FIGS. 4). The base member 6 can be used to shovel an area to form the temporary pocket 22. The cushioned portion 4 is preferably made of foam or foam like support material, and forms a horseshoe shape, upon which an individual places one's head and neck region, either in a face-up (FIG. 5.) or face-down (FIG. 4) position while reclining in a horizontal position. When the individual uses the device in a face down position, as seen in FIG. 4, an air channel 22 forms allowing the individual to have access to fresh air.

Figure 5:
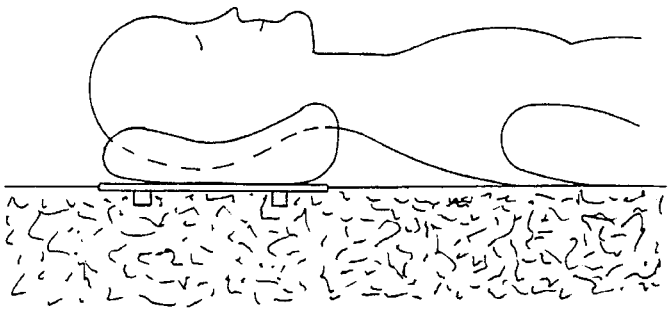
FIG. 5 is a side elevational view of a user of the in a supine face-up position.

If the individual is utilizing the device in a face-up position, as shown in FIG. 5, it is preferred, but not required, that the base member 6, be removed. Also, it is preferred, but not required, that the cushion portion 4, be rotated 180 degrees. In such a configuration, the leg members 12 of mounting base 8, are inserted into the ground to prevent the cushion portion from slipping or moving while the individual sleeps. Such a design is advantageous to the user in keeping the head and neck region in a strait position.

Figure 2A:
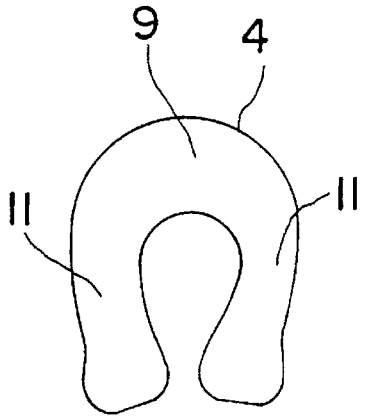
FIG. 2*a* is a top view of the cushion member.
Figure 2B:
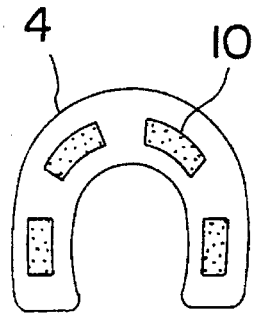
FIG. 2*b* is a bottom view of the cushion member.
Figure 2C:
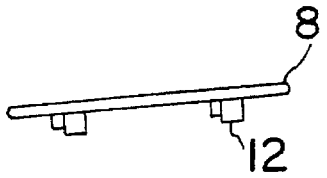
FIG. 2*c* is side view of the cushion frame.
Figure 3:
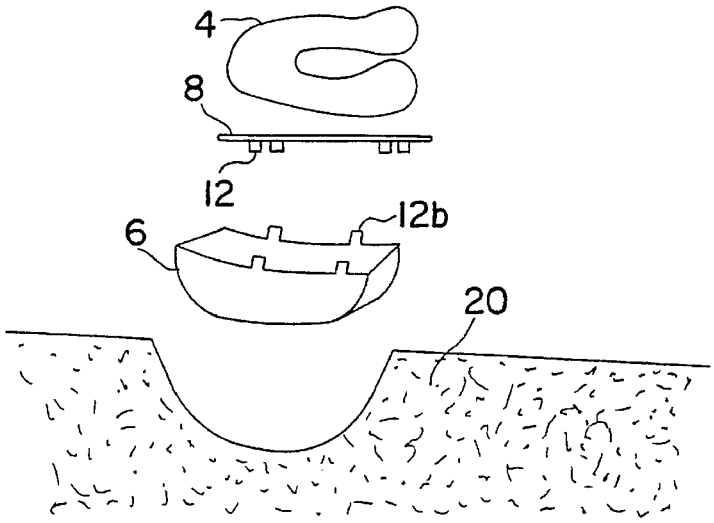
FIG. 3 is another perspective view of a head and support device of the present invention.

In a preferred embodiment, the cushioned portion has a first section 9 and a recessed region 11, or multiple recessed region 11 which accommodate the contours of the individual's face and/or neck regions as seen in FIG. 2. As mentioned above, the cushioned portion can be made of any suitable support material, such as foam. The foam material of the cushioned member can be modified to suit the needs of the individual user. It is expected that foams of various I.F.D (Indentation Force Deflection) ratings be used.

The cushioned member 4, is mounted to the base member 6, in any suitable manner. For instance, in FIG. 1, legs 12, which are mounted on cushion frame member 8, connect to receiving members 12*a*. In an alternative design, receiving members 12*a*, can be recessed (not shown) in base portion 6 to receive associated leg members 12. In the shown embodiment of FIG. 2*b*, cushion member 4 includes velcro™ strips 10, for attachment to mounting base 8.

It is readily understood that the head and neck support device of the present invention may be used in any number of configurations. The description of the manner of use given above is for exemplary purposes only.

I claim:

1. An apparatus for supporting an individual's head or neck, comprising: a base member and a cushion portion, said cushion portion being removably mounted on and spaced from said base member said cushion portion comprising a first section adapted to support an individual's head or neck, and additional recessed regions extending angularly from each end of said first section to form a substantially u-shaped cushion portion, said cushion portion being selectably engageable with an individual's head or neck, wherein an air channel is formed in said base member when said individual lies in a horizontal prone position.

2. The apparatus as defined by claim 1, wherein said cushion portion further comprises a frame having a plurality of legs which are removably mountable on said base member.

* * * * *